US007866945B2

(12) United States Patent
Ishihara et al.

(10) Patent No.: US 7,866,945 B2
(45) Date of Patent: Jan. 11, 2011

(54) AXIAL FLOW FAN

(75) Inventors: Katsumichi Ishihara, Nagano (JP); Honami Oosawa, Nagano (JP)

(73) Assignee: Sanyo Denki Co., Ltd., Tokyo (JP)

( * ) Notice: Subject to any disclaimer, the term of this patent is extended or adjusted under 35 U.S.C. 154(b) by 735 days.

(21) Appl. No.: 11/815,620

(22) PCT Filed: Feb. 2, 2006

(86) PCT No.: PCT/JP2006/301737

§ 371 (c)(1),
(2), (4) Date: Aug. 6, 2007

(87) PCT Pub. No.: WO2006/082876

PCT Pub. Date: Aug. 10, 2006

(65) Prior Publication Data

US 2009/0010759 A1 Jan. 8, 2009

(30) Foreign Application Priority Data

Feb. 7, 2005 (JP) ..... 2005-031097

(51) Int. Cl.
*F04D 29/54* (2006.01)

(52) U.S. Cl. ..... 415/208.1; 415/208.2; 415/211.2; 415/220; 416/247 R

(58) Field of Classification Search ..... 415/191, 415/192, 208.1, 208.2, 211.2, 220; 416/247 R
See application file for complete search history.

(56) References Cited

U.S. PATENT DOCUMENTS

| | | | | |
|---|---|---|---|---|
| 4,548,548 | A | 10/1985 | Gray, III | |
| 6,244,818 | B1 * | 6/2001 | Chang | 415/208.2 |
| 6,547,540 | B1 * | 4/2003 | Horng et al. | 415/208.2 |
| 6,663,342 | B2 * | 12/2003 | Huang et al. | 415/121.2 |
| 7,052,236 | B2 | 5/2006 | Chang et al. | |
| 2004/0033135 | A1 | 2/2004 | Chang | |
| 2004/0141841 | A1 | 7/2004 | Otsuka | |

FOREIGN PATENT DOCUMENTS

| | | |
|---|---|---|
| JP | 52-062712 | 5/1977 |
| JP | U54-169808 | 12/1979 |
| JP | 62-18398 | 2/1987 |
| JP | 62-070698 | 4/1987 |
| JP | 62-169297 | 10/1987 |
| JP | 62-169298 | 10/1987 |
| JP | 63-085297 | 4/1988 |
| JP | 63-171697 | 11/1988 |
| JP | 02-103197 | 8/1990 |

(Continued)

*Primary Examiner*—Igor Kershteyn
(74) *Attorney, Agent, or Firm*—Rankin, Hill & Clark LLP

(57) ABSTRACT

The present invention provides an axial flow fan capable of increasing an air volume and static pressure more than conventional axial flow fans. A plurality of rotary blades 5 are disposed in a circumferential direction of a rotary shaft 8 at equidistant intervals. A plurality of stationary blades 11 are disposed in the vicinity of a discharge opening 16 of an air channel portion 19 of a housing 3. The stationary blades are disposed in the circumferential direction of the rotary shaft 8 at equidistant intervals. The number of the rotary blades is seven (7) and the number of the stationary blades 11 is eight (8).

6 Claims, 11 Drawing Sheets

FOREIGN PATENT DOCUMENTS

| | | |
|---|---|---|
| JP | 07-083191 | 3/1995 |
| JP | 08-028491 | 1/1996 |
| JP | 11-294394 | 10/1999 |
| JP | 2000-303998 | 10/2000 |
| JP | 3083969 | 11/2001 |
| JP | U3092681 | 12/2002 |

* cited by examiner (A)

(B)

(C)

(A)
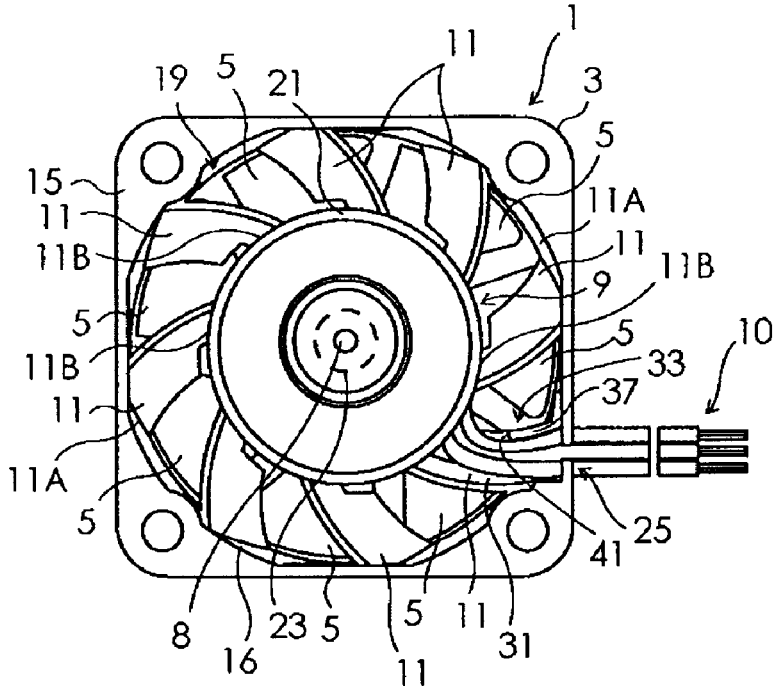
*Fig.2*
(B)
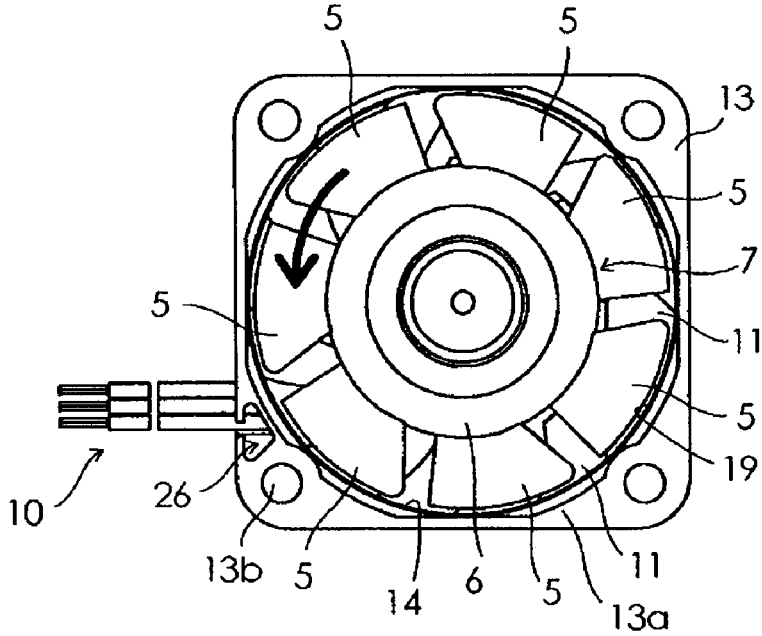

AXIAL FLOW FAN

TECHNICAL FIELD

The present invention relates to an axial flow fan used for cooling an inside of electrical equipment or the like.

BACKGROUND ART

When the size of electrical equipment is reduced, a space in which air flows inside a casing of the electrical equipment is also reduced. For this reason, as a fan used for cooling an inside of the casing, the fan characterized by an increased air volume and a higher static pressure is demanded. In the fan having such characteristics, it is also demanded to reduce noise as much as possible.

U.S. Pat. No. 6,244,818 or Japanese Patent Publication No. 2000-257597 (Patent Document 1), for example, discloses an axial flow fan including an impeller having nine rotary blades and 13 stationary blades disposed on the side of a discharge opening to fulfill this demand, as shown in FIGS. 1 and 4 of Patent Document 1.

DISCLOSURE OF THE INVENTION

Problem to be Solved by the Invention

It has been confirmed when a plurality of stationary blades are provided, the demand described above may be fulfilled. Recently, however, depending on an application, a higher performance fan is sometimes demanded, compared with existing axial flow fans including the stationary blades.

An object of the present invention is to provide an axial flow fan which attains more air volume and higher static pressure than ever.

Another object of the present invention is to provide an axial flow fan in which noise may be reduced more than ever.

Means for Solving the Problem

An axial flow fan of the present invention includes a housing, an impeller, a motor that rotates the impeller, and a plurality of stationary blades. The housing includes an air channel portion having a suction opening on one side of an axial direction of a rotary shaft and a discharge opening on the other side of the axial direction. The impeller includes a plurality of rotary blades that rotate within the air channel portion. The rotary blades are disposed in a circumferential direction of the rotary shaft at equidistant intervals. The motor causes the impeller to rotate about the rotary shaft in one rotating direction. The stationary blades are disposed in the vicinity of the discharge opening of the air channel portion. The stationary blades are disposed in the circumferential direction of the rotary shaft at equidistant intervals. In the present invention, the number of the rotary blades is seven (7), and the number of stationary blades is eight (8).

The inventors of the present invention studied a relationship of the number of rotary blades and the number of stationary blades with characteristics of the fan. The study has confirmed that the combination of seven rotary blades and eight stationary blades may increase the air volume and static pressure of the fan, compared with other combination in numbers of rotary and stationary blades. The study has also confirmed that, with this combination of rotary and stationary blades in number, noise generation may also be reduced more than other combinations. Therefore, the fan of the present invention may increase the air volume and static pressure more than ever, and may also reduce noise generation.

Preferably, the rotary blade may have a cross-sectional shape which is curved to form a concave portion opened toward one rotating direction of the impeller as the rotary blade is cross-sectioned in an orthogonal direction to the axial direction. In this case, the cross-sectional shape of the rotary blade is curved to form a convex portion raised toward an opposite direction to the one rotating direction as the rotary blade is cross-sectioned in the axial direction. Preferably, the stationary blade has a cross-sectional shape which is curved to form a concave portion opened toward an opposite direction to the one rotating direction as the stationary blade is cross-sectioned in an orthogonal direction to the axial direction. In this case, the cross-sectional shape of the stationary blade is curved to form a convex portion raised toward the one rotating direction as the stationary blade is cross-sectioned in the axial direction. Specifically, when the rotary and stationary blades are respectively shaped as described above, both of the maximum air volume and the maximum static pressure may be increased while suction noise may be reduced.

The impeller includes a rotary blade fixing member having a peripheral wall portion onto which the rotary blades are fixed. The stationary blades respectively have an outside end portion fixed to the inner wall portion of the air channel portion, and an inside end portion located opposite to the outside end portion in a radial direction of the rotary shaft. A stationary blade fixing member is disposed in a central portion of the air channel portion in the vicinity of the discharge opening of the air channel portion. The stationary blade fixing member includes a peripheral wall portion having an outer diameter which is equal to or smaller than an outer diameter of the peripheral wall portion of the rotary blade fixing member. With this arrangement, the stationary blade fixing member will not become a great resistance against an air flow generated by means of ration of the impeller. The inside end portion of each of the stationary blades is fixed onto the peripheral wall portion of the stationary blade fixing member. Accordingly, the stationary blade fixing member is fixed onto the housing by the stationary blades. The stationary blade fixing member may support a stator of the motor and a bearing that rotatably supports the rotary shaft.

Preferably, the stationary blades may respectively be shaped so that a side of the outside end portion that extends along the inner wall portion may be longer than a side of the inside end portion that extends along the peripheral wall portion of the stationary blade fixing member. More preferably, the stationary blades are respectively shaped as follows. First, it is assumed that a first hypothetical plane extends in a radial direction of the rotary shaft, passing through an end, located closest to the discharge opening, of the side of the inside end portion of the stationary blade and containing a centerline passing through the center of the rotary shaft. Next, it is assumed that a second hypothetical plane extends in the radial direction, passing through an end, located closest to the discharge opening, of the side of the outside end portion of the stationary blade and containing the centerline. Further, it is assumed that a third hypothetical plane extends in the radial direction, passing through an end, located closest to the suction opening, of the side of the outside end portion of the stationary blade and containing the centerline. Then, the stationary blades are respectively shaped so that a direction from the first hypothetical plane to the second hypothetical plane and a direction from the second hypothetical direction to the third hypothetical direction are respectively opposite to the one rotating direction of the impeller. When the shape of each of the stationary blades is determined as described above, the stationary blades may readily be shaped according to a desired characteristic. In this case, if an angle θ1 formed between the first hypothetical plane and the second hypothetical plane is larger than an angle θ2 formed between the second hypothetical plane and the third hypothetical plane, an air volume may be increased. Preferably, the angle θ1 is within the range of 25 to 30 degrees, and the angle θ2 is within the range of 15 to 20 degrees. With these angle settings, it may become easy to design an axial flow fan which attains more air volume and higher static pressure.

Preferably, the length of the side of the outside end portion of the stationary blade corresponds to 40 to 50% of the length of the rotary blade extending in the axial direction. With this length setting, it may become easy to design an axial flow fan which attains more air volume and higher static pressure.

A plurality of lead wires are sometimes used to supply electric power to the motor without using electrical connectors. In this case, the lead wires inevitably pass through an air channel in order that the lead wires may be pulled out from the housing. For this purpose, a lead wire engaging portion is provided to engage with the lead wires. The lead wire engaging portion is disposed at a wall portion surrounding the discharge opening of the air channel portion of the housing, and is configured to engage with the lead wires connected to the motor. Presence of the lead wires may not only affect the air volume and static pressure, but also may cause noise generation. Then, preferably, a guide wall portion may be provided to form a guide groove between the guide wall portion and one of the stationary blades, disposed in the vicinity of the lead wire engaging portion. The guide groove receives the lead wires therein and guides the lead wires to the lead wire engaging portion. When the guide wall portion as described above is provided and a plurality of lead wires are received in the guide groove, presence of the lead wires may have less adverse effect on the air volume and static pressure and may generate less noise.

As described above, each of the stationary blades includes an outside end portion fixed to an inner wall portion of the air channel portion and an inside end portion located opposite to the outside end portion in a radial direction of the rotary shaft. A stationary blade fixing member is disposed in a central portion of the air channel portion in the vicinity of the discharge opening. The stationary blade fixing member includes a peripheral wall portion onto which the inside end portion of each of the stationary blades is fixed. The guide wall portion includes a first end portion located on a side of the suction opening, a second end portion located on a side of the discharge opening, a third end portion located on a side of the inner wall portion of the air channel portion, and a fourth end portion located on a side of the stationary blade fixing member. Then, the first end portion of the guide wall portion extends from the inner wall portion of the air channel portion toward the stationary blade fixing member and is coupled to a suction-side end portion of the one stationary blade, located on the side of the suction opening, thereby forming the guide groove between the guide wall portion and the one stationary blade. With this arrangement, presence of the guide wall portion may suppress adverse effect on the relationship of the static pressure to the air volume and may also reduce noise generation.

Preferably, the third end portion of the guide wall portion is fixed to the inner wall portion of the air channel portion. When the guide wall portion is structured as described above, mechanical strength of the guide wall portion may be increased.

Preferably, the coupling portion between the first end portion and the suction-side end portion of the one stationary blade is shaped so as to become thinner toward the suction opening. With this arrangement, the coupling portion may be prevented from becoming a great resistance against an air flow generated by means of rotation of the impeller.

Further, it is preferable that the second end portion of the guide wall portion may be flush with a hypothetical opening surface of the discharge opening. In this case, it is preferable that the guide wall portion may extend from the first end portion to the second end portion so that the guide wall portion may substantially become orthogonal to the hypothetical opening surface of the discharge opening. When the guide wall portion is provided as described above, a resistance against an air flow, generated due to the presence of the guide wall portion, may be further reduced.

The lead wire engaging portion may include a through hole formed in the housing and disposed adjacent to the outside end portion of the one stationary blade, and a slit formed in the housing. The through hole communicates an inside of the air channel portion with an outside of the housing. The slit communicates with the through hole and is opened to the other side of the axial direction. In this case, a size of the slit is determined so that the lead wires, which are received in the guide groove and go out via the through hole, do not readily get out of the slit. When the lead wire engaging portion is configured as described above, the lead wires may readily be inserted into the guide groove and pulled out to the outside of the housing. When the lead wire engaging portion is configured as described above, it is preferable that the third end portion of the guide wall portion may be fixed to the inner wall portion of the air channel portion. Then, it is preferable that a length of the guide wall portion extending along the one stationary blade may be determined so as to prevent a part of an air flow generated by means of rotation of the impeller from actively flowing out to the outside of the housing via the through hole. With this arrangement, the air flow substantially does not go out via the through hole, thereby generating less noise.

BRIEF DESCRIPTION OF THE DRAWINGS

FIG. 2A is a front view of the axial flow fan of FIG. 1 with a seal on the side of a motor removed.

FIG. 2B is a rear view of the axial flow fan of FIG. 1 with the seal on the side of the motor removed.

BEST MODE FOR CARRYING OUT THE INVENTION

Figure 3:
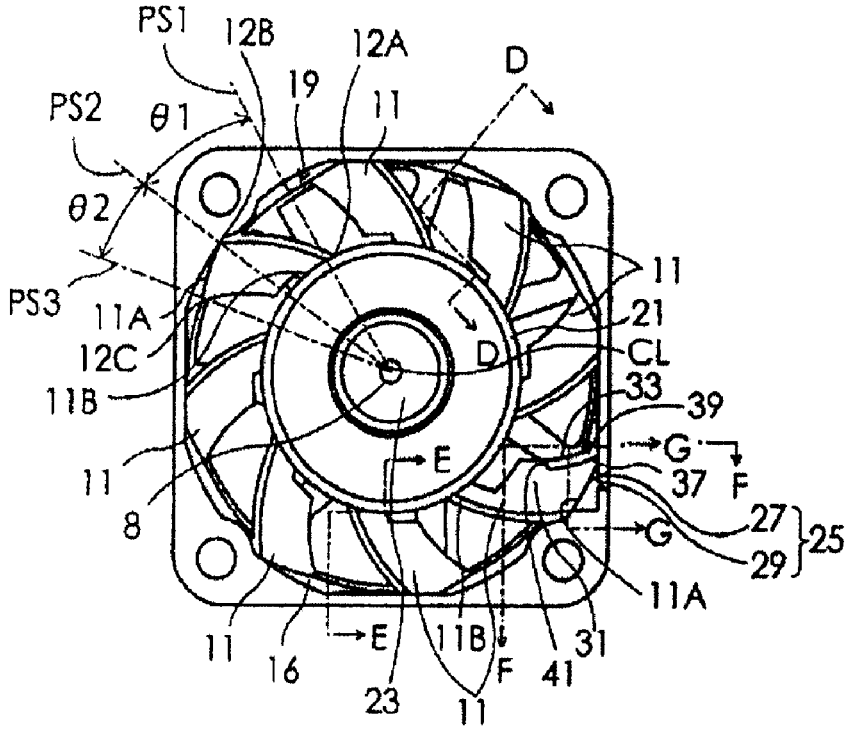
FIG. 3 is a plan view of the axial flow fan with the three lead wires and the seal removed.
Figure 4:
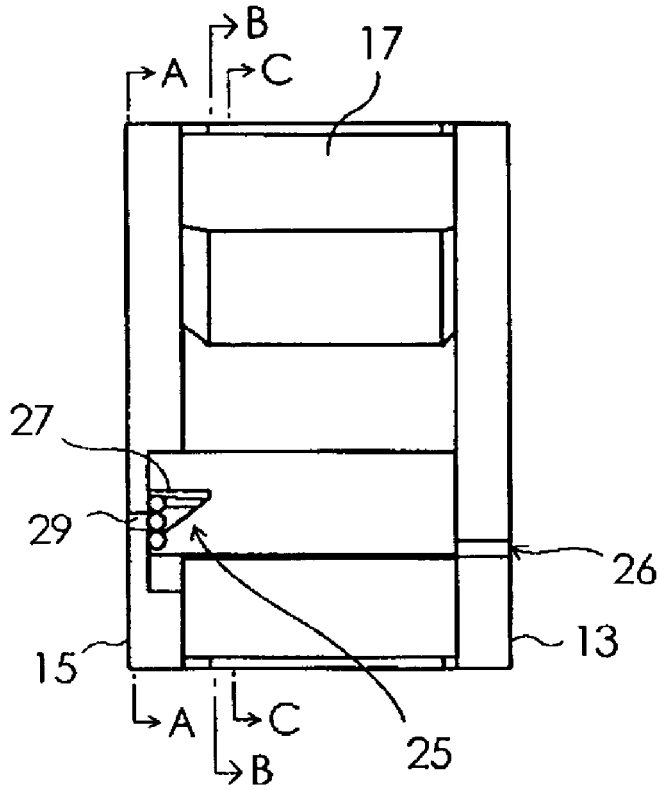
FIG. 4 is a right side view of the axial flow fan of FIG. 2A.
Figure 5:
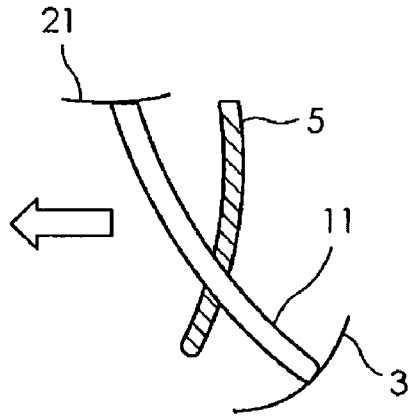
FIG. 5 is a diagram for explaining a relationship between a rotary blade and a stationary blade.
Figure 6:
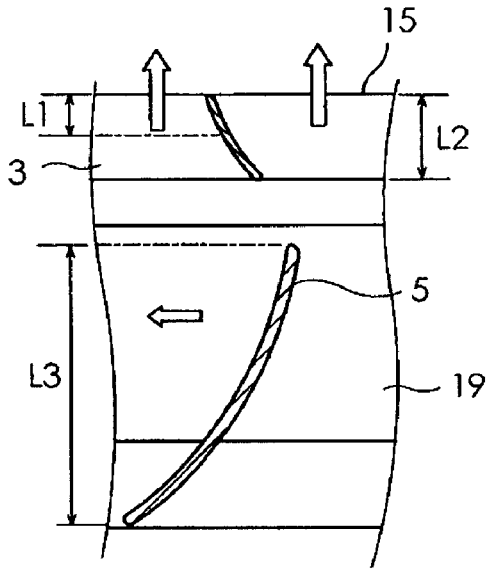
FIG. 6 is a diagram for explaining a relationship between a rotary blade and a stationary blade.
Figure 7:
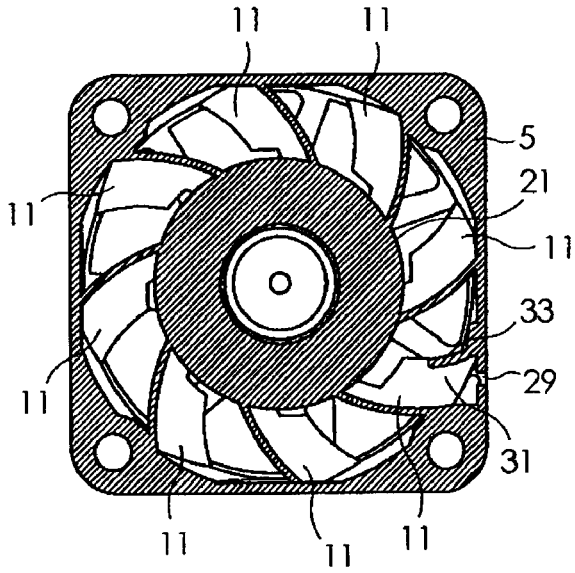
FIG. 7 is a sectional view taken along line. A-A of FIG. 4, with an internal structure of the motor omitted.
Figure 8:
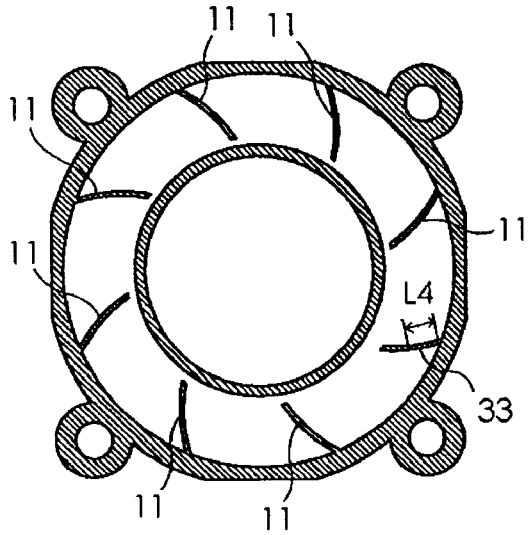
FIG. 8 is a sectional view taken along line B-B of FIG. 4.
Figure 9:
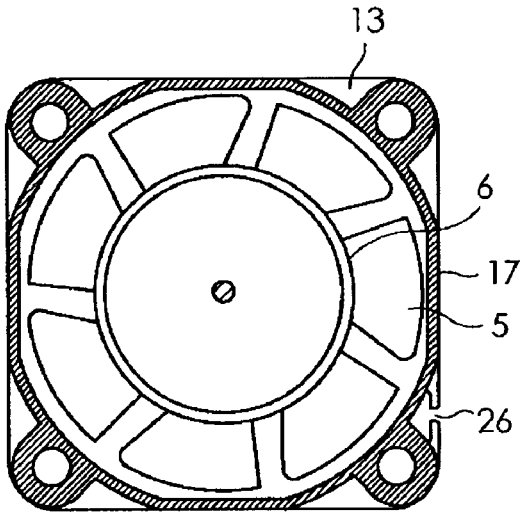
FIG. 9 is a sectional view taken along line C-C of FIG. 4, with the internal structure of the motor omitted.

An axial flow fan according to an embodiment of the present invention will be described below in detail with reference to drawings. FIG. 1A is a perspective view of an axial flow fan 1 according to the embodiment of the present invention, as viewed from front upper right. FIG. 1B is a perspective view of the axial flow fan 1, as viewed from rear upper left. FIG. 1C is a perspective view of the axial flow fan 1, as viewed from front upper right, wherein three lead wires 10 are omitted from the illustration. FIGS. 2A and 2B are respectively a front view and a rear view with a seal 2 on the side of a motor 9 removed. FIG. 3 is a plan view of the axial flow fan 1 with the three lead wires 10 and the seal 2 removed. FIG. 4 is a right side view of the axial flow fan 1 of FIG. 2A. FIGS. 5 and 6 are diagrams used for explaining a relationship between a rotary blade 5 and a stationary blade 11, which will be described later. FIGS. 7, 8, and 9 are respectively a sectional view taken along line. A-A of FIG. 4, from which an internal structure of the motor is omitted, a sectional view taken along line B-B of FIG. 4, and a sectional view taken along line C-C of FIG. 4, from which the internal structure of the motor is omitted.

Figure 1:
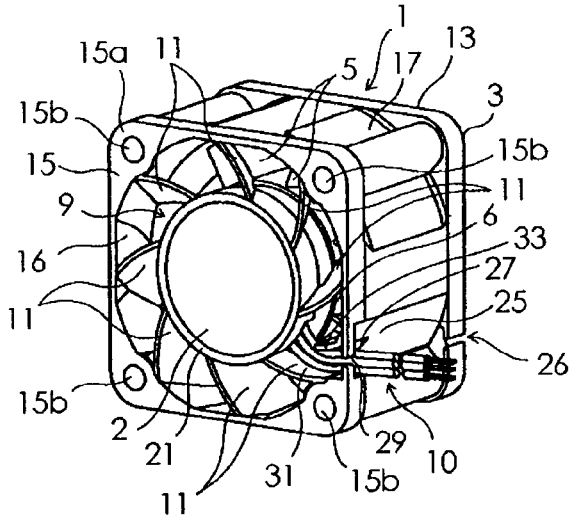
FIG. 1A is a perspective view of an axial flow fan according to an embodiment of the present invention, as viewed from front upper right.
FIG. 1B is a perspective view of the axial flow fan, as viewed from rear upper left.
FIG. 1C is a perspective view of the axial flow fan, as viewed from front upper right, wherein three lead wires are omitted from the illustration.
Figure 1:
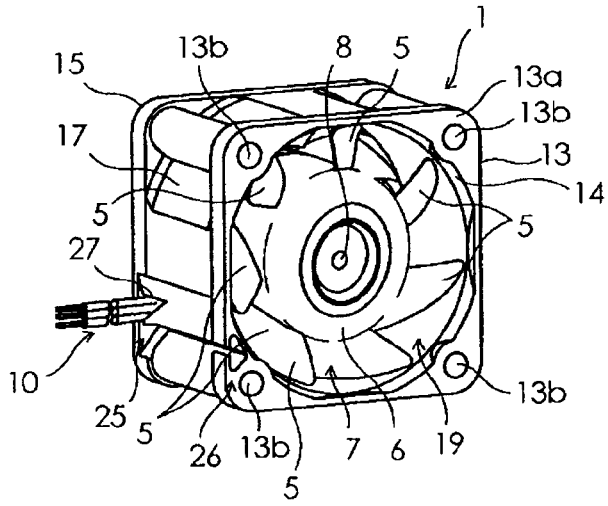
Figure 1:
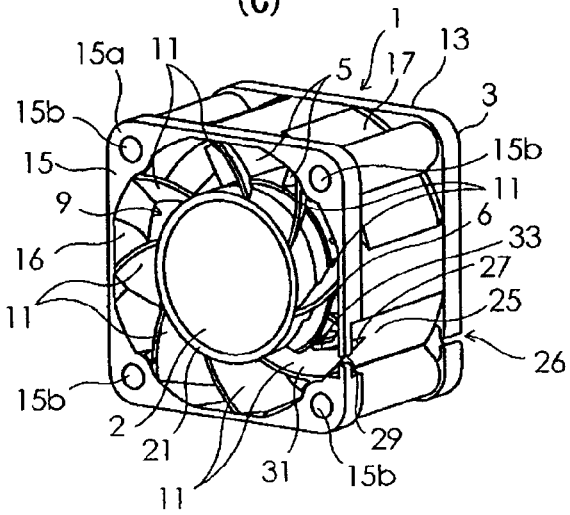

Referring to these drawings, the axial flow fan 1 includes a housing 3, an impeller 7 including seven rotary blades 5 that are disposed inside the housing 3 and rotate, a motor 9 including a rotary shaft 8 to which the impeller 7 is attached, and eight stationary blades 11. As shown in FIGS. 1 and 2, the housing 3 includes an annular suction-side flange 13 in one side of a direction (an axial direction) in which an axis line of the rotary shaft 8 extends. The housing 3 also includes an annular discharge-side flange 15 in the other side of the axial direction. The housing 3 also includes a cylindrical portion 17 disposed between the flanges 13 and 15. An air channel portion 19 is formed by respective internal spaces of the flange 13, flange 15, and cylindrical portion 17.

The suction-side flange 13 has substantially a square contour shape, and has a suction opening 14 of substantially a circular shape. The suction-side flange 13 has a flat surface 13*a* at each of four corner portions thereof. In each of the four corner portions, a through hole 13*b*, through which a mounting screw passes, is formed.

The discharge-side flange 15 also has substantially a square contour shape, and has a discharge opening 16 of substantially a circular shape. The discharge-side flange 15 has a flat surface 15*a* at each of four corner portions thereof. In each of the four corner portions, a through hole 15*b*, through which a mounting screw passes, is formed.

The impeller 7 includes a rotary blade fixing member 6 of a cup shape. Seven rotary blades 5 are fixed to a peripheral wall portion of the rotary blade fixing member 6. A plurality of permanent magnets that constitute a part of a rotor of the motor 9 are fixed onto the inside of the peripheral wall portion of the rotary blade fixing member 6.

As shown in FIGS. 2A and 3, the eight stationary blades 11 respectively include an outside end portion 11A fixed to an inner wall portion of the air channel portion 19 and an inside end portion 11B located opposite to the outside end portion 11A in a radial direction of the rotary shaft 8. In a central portion of the air channel portion 19 in the vicinity of the discharge opening 16, a stationary blade fixing member 21 of a cup shape is disposed. The stationary blade fixing member 21 includes a peripheral wall portion having an outer diameter size equal to or smaller than an outer diameter size of the peripheral wall portion of the rotary blade fixing member 6. With this diameter setting, the stationary blade fixing member 21 will not be a great resistance to an air flow generated by means of rotation of the impeller 7. The inside end portion 11B of each of the eight stationary blades 11 is fixed to the peripheral wall portion of the stationary blade fixing member 21. As a result, the stationary blade fixing member 21 is fixed to the housing 3 by the eight stationary blades 11. A bearing 23 that rotatably supports a stator of the motor 9, not shown, and the rotary shaft 8 are supported by the stationary blade fixing member 21.

As shown in FIG. 5, each of the seven rotary blades has a cross-sectional shape which is curved to form a concave portion opened toward the rotating direction of the impeller 7 (clockwise in FIG. 2A or counterclockwise in FIG. 2B) as the rotary blade 5 is cross-sectioned in an orthogonal direction to the axial direction of the rotary shaft 8. In other words, as shown in FIG. 6, the cross-sectional shape of each of the seven rotary blades 5 is curved to form a convex portion raised toward an opposite direction to the rotating direction of the impeller 7 as the rotary blade is cross-section in the axial direction. As shown in FIG. 5, each of the stationary blades 11 has a cross-sectional shape which is curved to form a concave portion opened toward an opposite direction to the rotating direction of the impeller 7 as the stationary blade is cross-sectioned in an orthogonal direction to the axial direction. In other words, as shown in FIG. 6, the cross-sectional shape of each of the eight stationary blades 11 is curved to form a convex portion raised toward the rotating direction as the stationary blade is cross-sectioned in the axial direction.

Figure 10:
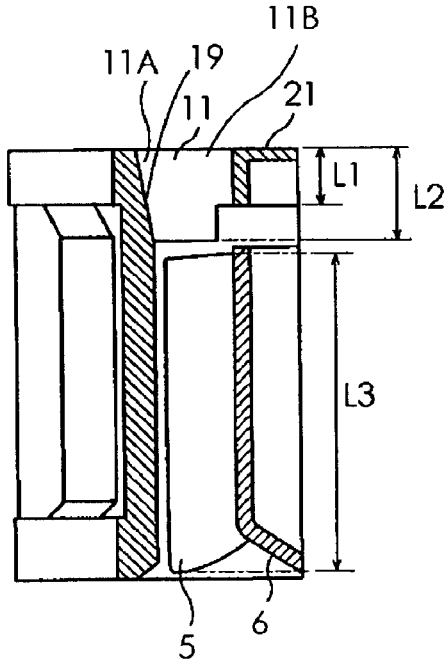
FIG. 10 is a sectional view taken along line D-D of FIG. 3.
Figure 11:
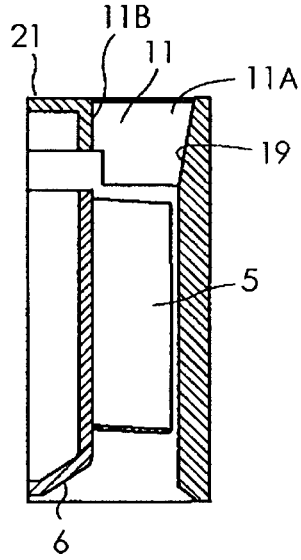
FIG. 11 is a sectional view taken along line E-E of FIG. 3.

As shown in FIGS. 6 and 10, each of the eight stationary blades 11 is shaped so that a side length L2 of the outside end portion 11A of the stationary blade 11, a length of a side of the outside end portion 11A of the stationary blade 11, which extends along the inner wall portion of the air channel portion 19 may be longer than a side length L1 of the inside end portion 11B of the stationary blade 11, or a length of a side of the inside end portion 11B of the stationary blade 11, which extends along the peripheral wall portion of the stationary blade fixing member 21. The side length L1 of the inside end portion 11B of one stationary blade 11 disposed adjacent to a lead wire engaging portion 25, which will be described later, is shorter than the side length L1 of the inside end portion 11B of other stationary blades 11. This arrangement is intended to readily pull out the lead wires 10 from the motor 9.

Referring to FIG. 3, how to determine the shape of the stationary blade 11 will be described. First, it is assumed that a first hypothetical plane PS1 extends in a radial direction of the rotary shaft 8, passing through an end 12A, located closest to the discharge opening 16, of the side of the inside end portion 11B of the stationary blade 11 and containing a centerline CL passing through the center of the rotary shaft 8. Next, it is assumed that a second hypothetical plane PS2 extends in the radial direction, passing through an end 12B, located closest to the discharge opening 16, of the side of the outside end portion 11A of the stationary blade 11 and containing the centerline CL. Further, it is assumed that a third hypothetical plane PS3 extends in the radial direction, passing through an end 12C, located closest to the suction opening 14, of the side of the outside end portion 11A of the stationary blade 11 and containing the centerline CL. Then, the stationary blades 11 are respectively shaped so that a direction from the first hypothetical plane PS1 to the second hypothetical plane PS2 and a direction from the second hypothetical plane PS2 to the third hypothetical plane PS3 are respectively opposite to the rotating direction of the impeller 7. When the shape of the stationary blade 11 is defined as described above, it becomes easy to determine the shape of the stationary blade according to a desired characteristic. In this embodiment, an angle θ1 formed between the first hypothetical plane PS1 and the second hypothetical plane PS2 is larger than an angle θ2 formed between the second hypothetical plane PS2 and the third hypothetical plane PS3. Specifically, the angle θ1 is 30 degrees, while the angle θ2 is 20 degrees. A preferable range of the angle θ1 is 25 to 30 degrees, while a preferable range of the angle θ2 is 15 to 20 degrees. When the angles θ1 and θ2 are determined as described above, it may become easy to design an axial flow fan with an increased air volume and a higher static pressure.

As shown in FIGS. 6 and 10, it is preferable that the side length L2 of the outside end portion 11A of the stationary blade may correspond to 40 to 50% of the length L3 of the rotary blade 5 that extends in the axial direction. When the length L2 is determined as described above, it may become easy to design an axial flow fan with an increased air volume and a higher static pressure.

The lead wire engaging portion 25 to engage with the three lead wires 10 is provided at the housing 3. The lead wire engaging portion 25 includes a through hole 27 that is formed in the cylindrical portion 17 of the housing 3, being disposed adjacent to the outside end portion 11A of an adjacent stationary blade 11, and a slit 29 formed in the flange 15 of the housing 3. The through hole 27 communicates an inside of the air channel portion 19 with an outside of the housing 3. The slit 29 communicates with the through hole 27 and is opened to the other side of the axial direction. In this case, a width of the slit 29 is determined so that the three lead wires 10 may not readily get out of the slit 29. The three lead wires 10 are received in a guide groove 31, which will be described later, and go out via the through hole 27. When the lead wire engaging portion 25 is configured as described above, the lead wires 10 may readily be inserted into the guide groove 31 and pulled out of the housing 3. In this embodiment, at the flange 13 of the housing 3 as well, a lead wire engaging portion 26 is formed to engage with the lead wires 10 bent along the cylindrical portion 17.

Figure 12:
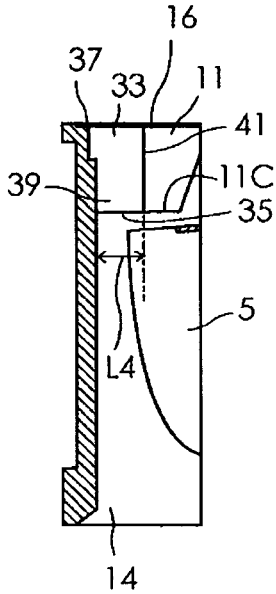
FIG. 12 is a sectional view taken along line F-F of FIG. 3.

In this embodiment, as shown in FIGS. 1A and 1C, 2A, 3, 11, and 12, a guide wall portion 33 is provided to form the guide groove 31, which receives the lead wires 10 and guides them to the lead wire engaging portion 25, between the guide wall portion 33 and one of the stationary blades 11, disposed in the vicinity of the lead wire engaging portion 25. As shown in FIG. 12, in particular, the guide wall portion 33 includes a first end portion 35 located on a side of the suction opening 14, a second end portion 37 located on a side of the discharge opening 16, a third end portion 39 located on a side of the inner wall portion of the air channel portion 19, and a fourth end portion located on a side of the stationary blade fixing member 21. The first end portion 35 of the guide wall portion extends from the inner wall portion of the air channel portion 19 toward the stationary blade fixing member 21 and is coupled to a suction-side end portion 11C of the stationary blade 11, located on the side of the suction opening 14, thereby forming a coupling portion. As a result, the guide groove 31 is formed between the guide wall portion 33 and the one stationary blade 11.

Figure 13:
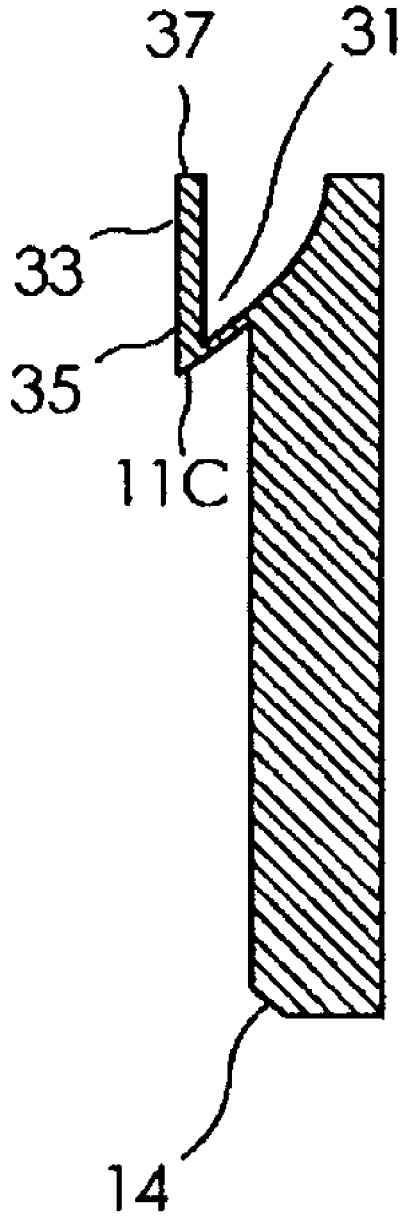
FIG. 13 is a sectional view taken along line G-G of FIG. 3.

The third end portion 39 of the guide wall portion is fixed to the inner wall portion of the air channel portion 19. As shown in FIG. 13, the coupling portion between the first end portion 35 of the guide wall portion and the suction-side end portion 11C of the stationary blade 11 is shaped so as to become thinner toward the suction opening 14. As a result, the coupling portion may not become a great resistance against an air flow generated by means of rotation of the impeller 7.

Further, in this embodiment, the second end portion 37 of the guide wall portion 33 is flush with a hypothetical opening surface of the suction opening 16. In this case, the guide wall portion 33 extends from the first end portion 35 to the second end portion 37 so that the guide wall portion 33 may substantially become orthogonal to the hypothetical opening surface of the opening portion 16 or may become parallel to the rotary shaft 8. When the guide wall portion 33 is provided as described above, a resistance against an air flow, generated due to presence of the guide wall portion 33, may be further reduced. As a result, when the guide wall portion 33 as described above is provided and a plurality of lead wires are received in the guide groove, presence of the lead wires may have less adverse effect on the air volume and static pressure, and may generate less noise.

In this embodiment, a length L4 (refer to FIGS. 8 and 12) of the guide wall portion 33 extending along the stationary blade 11 is determined so as to prevent a part of an air flow generated by means of rotation of the impeller 7 from actively flowing out from the housing 3 via the through hole 27. As a result, substantially no air flows out via the through hole 27, and noise generation is reduced.

Figure 14:
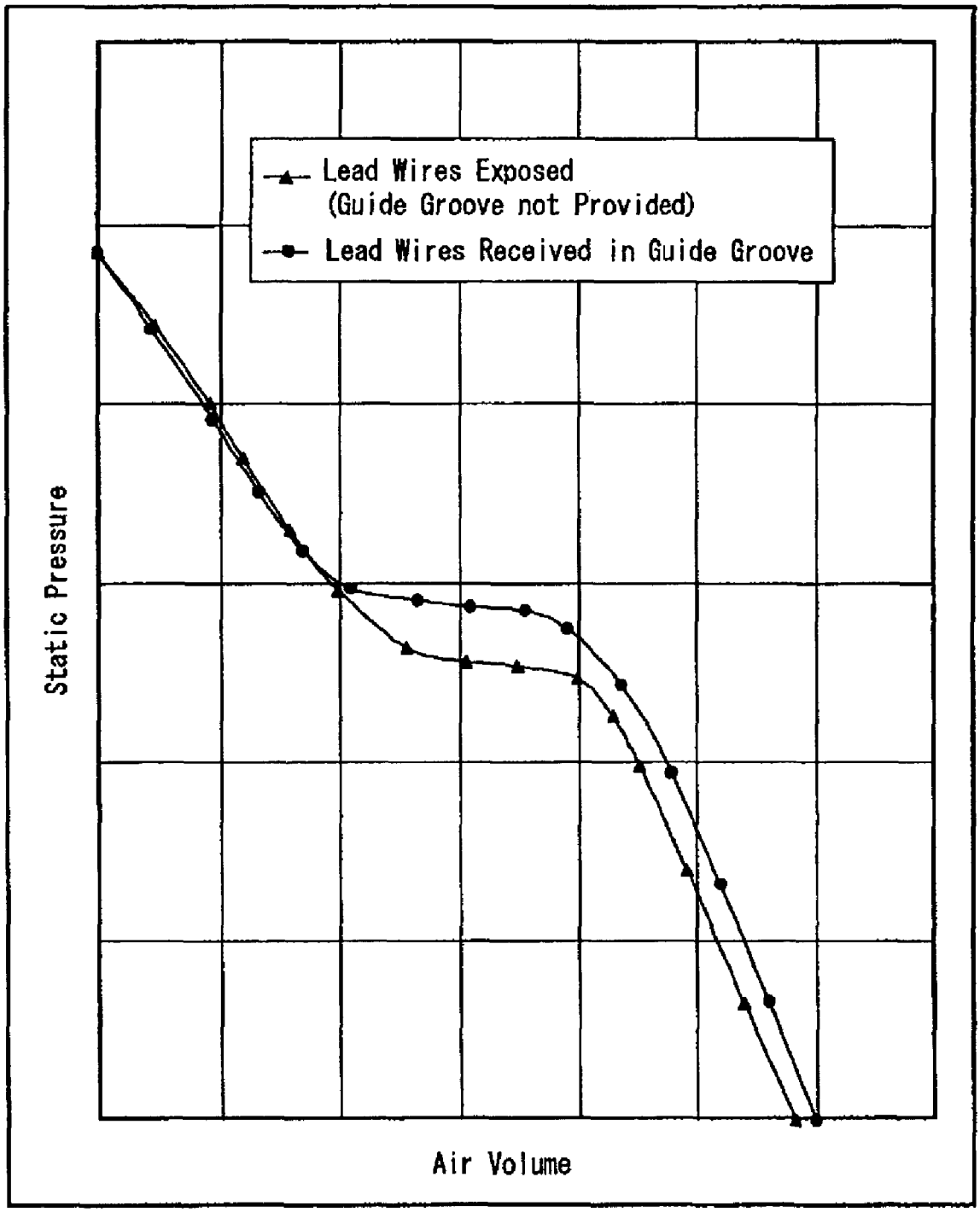
FIG. 14 is a graph showing results of measurement of air volume-static pressure characteristics in both cases where the guide wall portion was provided and where the guide wall portion was not provided.

Further, air volume-static pressure characteristics were measured in both cases where the guide wall portion 33 was provided and where the guide wall portion 33 was not provided, in order to confirm effect brought about by providing the guide wall portion 33. Also, a sound pressure level was measured. Results of measurement of the air volume-static pressure characteristics are shown in FIG. 14. The measurement was made with a rotational speed of the motor fixed at 13000 rpm. As seen from FIG. 14, it was confirmed that the air volume could be more increased and the static pressure could also be more increased when the guide wall portion 33 was provided and the lead wires were received in the guide groove 31. With regard to the sound pressure level, it was confirmed that, when the sound pressure level with the lead wires received in the guide groove was defined as Lp[dB(A)], the sound pressure level with the guide wall portion 33 removed increased to Lp+3[dB(A)]. Accordingly, it was found that when the guide wall portion 33 was provided, noise could also be reduced.

Figure 15:
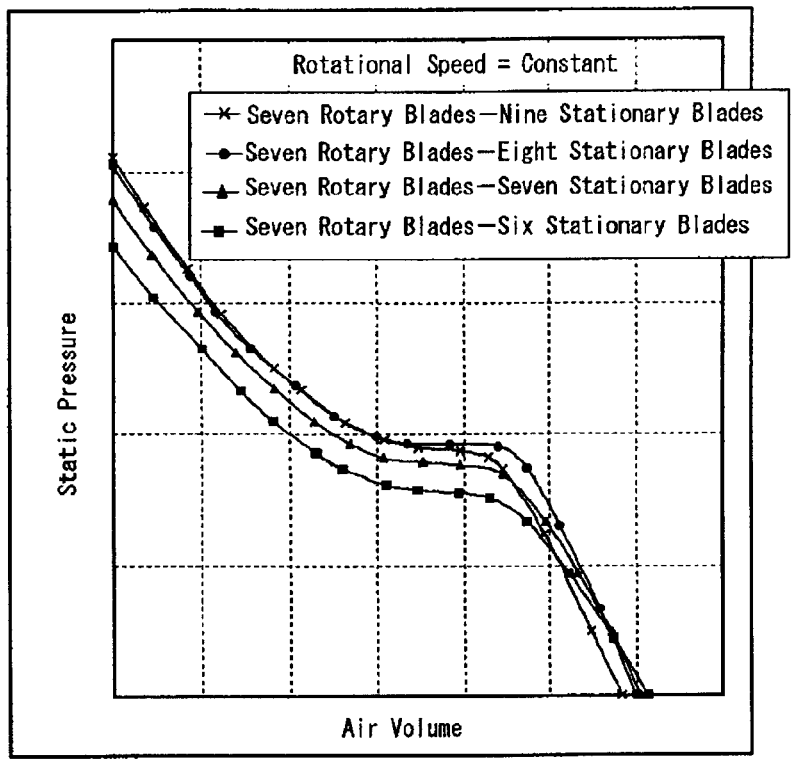
FIG. 15 is a graph showing results of measurement when the number of rotary blades was seven and the number of stationary blades was changed.
Figure 16:
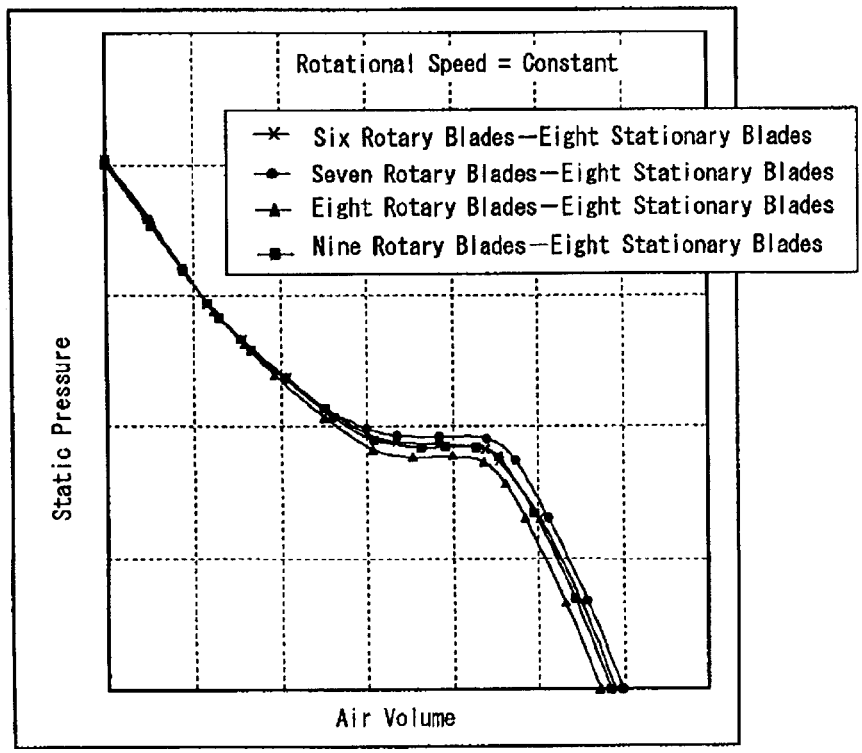
FIG. 16 is a graph showing results of measurement when the number of the rotary blades was changed and the number of the stationary blades was eight.

Next, a test was conducted where the number of the rotary blades 5 and the number of the stationary blades 11 were changed so as to confirm that characteristics of the axial flow fan in this embodiment are excellent. FIG. 15 shows results of measurement when the number of the rotary blades was fixed at seven and the number of the stationary blades was changed. Referring to FIG. 15, a round symbol of ● shows a result when the number of the rotary blades was seven and the number of the stationary blades was eight, a triangle symbol of ▲ shows a result when the number of the rotary blades was seven and the number of the stationary blades was seven, a square symbol of ■ shows a result when the number of the rotary blades was seven and the number of the stationary blades was six, and a cross symbol of x shows a result when the number of the rotary blades was seven and the number of the stationary blades was nine. FIG. 16 shows results of measurement when the number of the rotary blades was changed and the number of stationary blades was fixed at eight. Referring to FIG. 16, a round symbol of ● shows a result when the number of the rotary blades was seven and the number of the stationary blades was eight, a triangle symbol of ▲ shows a result when the number of the rotary blades was eight and the number of the stationary blades was eight, a square symbol of ■ shows a result when the number of the rotary blades was nine and the number of the stationary blades was eight, and a cross symbol of x shows a result when the number of the rotary blades was six and the number of the stationary blades was eight. As seen from FIGS. 15 and 16, both of the air volume and the static pressure increased when the number of the rotary blades 5 was seven and the number of the stationary blades 11 was eight.

Table 1 below shows results of measurement of the sound pressure level when the number of the rotary blades was fixed and the number of the stationary blades was changed, and when the number of the rotary blades was changed and the number of the stationary blades was fixed.

TABLE 1

| Number of Blades | Sound Pressure Level |
|---|---|
| 7 rotary blades, 6 stationary blades | Lp + −0 |
| 7 rotary blades, 7 stationary blades | Lp + 5 |
| 7 rotary blades, 8 stationary blades | Lp |
| 7 rotary blades, 9 stationary blades | Lp + 0 |
| 8 rotary blades, 8 stationary blades | Lp + 10 |
| 9 rotary blades, 8 stationary blades | Lp + 3 |

The sound pressure level is shown as a change in the sound pressure level when the guide wall portion 33 is removed, provided that the sound pressure level with the lead wires received in the guide groove 31 is defined as Lp[dB(A)]. More specifically Lp+5 [dB(A)] indicates that the sound pressure level increased by 5 [dB(A)] from the sound pressure level of Lp[dB(A)] when the lead wires were received in the guide groove 31. It can be seen from Table 1 that the sound pressure level increased except in cases where the numbers of the rotary blades and the stationary blades were seven and eight, respectively, and where the numbers of the rotary blades and the stationary blades were seven and six, respectively. In both cases, the sound pressure level remained unchanged.

It can be seen from the results of measurement described above that the maximum air volume may be increased, the maximum static pressure may be increased, and suction noise may also be reduced when the number of the rotary blades is seven and the number of the stationary blades is eight, as in the axial flow fan of this embodiment. A simulation confirmed that this tendency also appeared even when the shape of the rotary blades and the shape of the stationary blades were changed.

INDUSTRIAL APPLICABILITY

According to an axial flow fan of the present invention, both of the air volume and static pressure of the fan may be increased more than ever by defining a relationship in numbers of rotary and stationary blades. In addition, noise generation may also be reduced.

The invention claimed is:

1. An axial flow fan comprising:

a housing including an air channel portion having a suction opening on one side of an axial direction of a rotary shaft and a discharge opening on the other side of the axial direction;

an impeller including a plurality of rotary blades that rotate within the air channel portion, the plurality of rotary blades being disposed at equidistant intervals in a circumferential direction of the rotary shaft;

a motor that causes the impeller to rotate about the rotary shaft in one rotating direction; and a plurality of stationary blades disposed in the vicinity of the discharge opening of the air channel portion, the plurality of stationary blades being disposed at equidistant intervals in the circumferential direction of the rotary shaft;

wherein the number of the rotary blades is seven and the number of the stationary blades is eight, wherein the impeller includes a rotary blade fixing member having a peripheral wall portion onto which the rotary blades are fixed, wherein the stationary blades respectively have an outside end portion fixed to the inner wall portion of the air channel portion, and an inside end portion located opposite to the outside end portion in a radial direction of the rotary shaft, wherein a stationary blade fixing member is disposed in a central portion of the air channel portion in the vicinity of the discharge opening, the stationary blade fixing member including a peripheral wall portion having an outer diameter which is equal to or smaller than an outer diameter of the peripheral wall portion of the rotary blade fixing member, wherein the inside end portion of each of the stationary blades is fixed onto the peripheral wall portion of the stationary blade fixing member, wherein the stationary blades are respectively shaped so that a side of the outside end portion that extends along the inner wall portion may be longer than a side of the inside end portion that extends along the peripheral wall portion of the stationary blade fixing member, wherein the stationary blades are respectively shaped so that, assuming that a first hypothetical plane extends in a radial direction of the rotary shaft, passing through an end, located closest to the discharge opening, of the side of the inside end portion of the stationary blade and containing a centerline passing through the center of the rotary shaft, a second hypothetical plane extends in the radial direction, passing through an end, located closest to the discharge opening, of the side of the outside end portion of the stationary blade and containing the centerline, and a third hypothetical plane extends in the radial direction, passing through an end, located closest to the suction opening, of the side of the outside end portion of the stationary blade and containing the centerline, a direction from the first hypothetical plane to the second hypothetical plane and a direction from the second hypothetical direction to the third hypothetical direction are respectively opposite to the one rotating direction of the impeller, and wherein an angle θ1 formed between the first hypothetical plane and the second hypothetical plane is larger than an angle θ2 formed between the second hypothetical plane and the third hypothetical plane.

2. The axial flow fan according to claim 1, wherein the angle θ1 is 25 to 30 degrees, and the angle θ2 is 15 to 20 degrees.

3. The axial flow fan according to claim 1, wherein the length of the side of the outside end portion of the stationary blade corresponds to 40 to 50% of the length of the rotary blade extending in the axial direction.

4. The axial flow fan according to claim 1, wherein the stationary blade fixing member supports a stator of the motor and a bearing which rotatably supports the rotary shaft.

5. The axial flow fan according to claim 1, wherein the rotary blade has a cross-sectional shape which is curved to form a concave portion opened toward the one rotating direction as the rotary blade is cross-sectioned in an orthogonal direction to the axial direction; and the stationary blade has a cross-sectional shape which is curved to form a concave portion opened toward an opposite direction to the one rotating direction as the stationary blade is cross-sectioned in an orthogonal direction to the axial direction.

6. The axial flow fan according to claim 1, wherein the rotary blade has a cross-sectional shape which is curved to form a convex portion raised toward an opposite direction to the one rotating direction as the rotary blade is cross-sectioned in the axial direction; and the stationary blade has a cross-sectional shape which is curved to form a convex portion raised toward the one rotating direction as the stationary blade is cross-sectioned in the axial direction.

* * * * *